US006192519B1

(12) United States Patent
Coalter

(10) Patent No.: US 6,192,519 B1
(45) Date of Patent: Feb. 27, 2001

(54) ATHLETIC SPORTS PAD

(76) Inventor: Kathleen L. Coalter, 149 White, Sparta, MI (US) 49345

( * ) Notice: Subject to any disclaimer, the term of this patent is extended or adjusted under 35 U.S.C. 154(b) by 0 days.

(21) Appl. No.: 09/272,263

(22) Filed: Mar. 19, 1999

(51) Int. Cl.[7] ..... A41D 13/08
(52) U.S. Cl. ..... 2/16; 2/59; 2/170
(58) Field of Search ..... 2/22, 16, 24, 170, 2/455, 162, 267, 59, 60, 910; 602/20–23; 128/878, 880

(56) References Cited

U.S. PATENT DOCUMENTS

| | | | | |
|---|---|---|---|---|
| Re. 22,167 | | 8/1942 | Wells et al. . | |
| D. 259,220 | | 5/1981 | Small et al. . | |
| 1,179,871 | | 4/1916 | St. John . | |
| 1,420,361 | * | 6/1920 | Bennett | 2/24 |
| 1,489,784 | | 4/1924 | O'Shea . | |
| 1,516,981 | | 11/1924 | O'Shea . | |
| 2,127,926 | | 8/1938 | Mason . | |
| 2,821,718 | | 2/1958 | Hall et al. . | |
| 3,189,919 | | 6/1965 | Chase . | |
| 3,322,118 | | 5/1967 | Sotherlin . | |
| 3,406,406 | * | 10/1968 | Lutz | 2/24 |
| 3,587,572 | * | 6/1971 | Evans | 128/80 |
| 3,606,614 | | 9/1971 | Dimitroff . | |
| 3,649,967 | | 3/1972 | Millman . | |
| 4,053,676 | | 10/1977 | Kaminstein . | |
| 4,061,256 | | 12/1977 | Beer et al. . | |
| 4,068,318 | | 1/1978 | McMahon . | |
| 4,183,100 | | 1/1980 | De Marco . | |
| 4,193,134 | | 3/1980 | Hanrahan et al. . | |
| 4,224,692 | | 9/1980 | Sundberg . | |
| 4,244,057 | | 1/1981 | Burnham . | |
| 4,270,228 | | 6/1981 | Gaiser . | |
| 4,316,926 | | 2/1982 | Kaminstein . | |
| 4,359,783 | | 11/1982 | Andrews . | |
| 4,464,796 | | 8/1984 | Heissenberger et al. . | |
| 4,691,387 | | 9/1987 | Lopez . | |
| 4,756,026 | | 7/1988 | Pierce, Jr. . | |
| 4,774,727 | | 10/1988 | Jackson . | |
| 4,810,559 | | 3/1989 | Fortier et al. . | |
| 4,832,010 | * | 5/1989 | Lerman | 128/165 |
| 4,843,653 | | 7/1989 | Coble . | |
| 4,856,112 | * | 8/1989 | Effle | 2/59 |
| 4,881,276 | | 11/1989 | Swan . | |
| 4,896,378 | | 1/1990 | Campana . | |
| 5,143,762 | * | 9/1992 | Ho | 2/16 |

(List continued on next page.)

FOREIGN PATENT DOCUMENTS

| | | |
|---|---|---|
| 2039936 | 10/1992 | (CA) . |
| 399274 | 11/1990 | (EP) . |
| 649632 | 1/1951 | (GB) . |

OTHER PUBLICATIONS

"Sara Glove Safety Products", and "Worldwide Outfitters", *Catalog 1110*, two pages.
"Medalist Gladiator's New Product Development In Sport Protective Equipment . . . Lookin' Great", *Medalist Gladiator*, Medalist Industries, 1977.

*Primary Examiner*—Gloria M. Hale
*Assistant Examiner*—Tejash Patel
(74) *Attorney, Agent, or Firm*—Van Dyke, Gardner, Linn & Burkhart, LLP

(57) ABSTRACT

A sports pad for use by a contact sports player, such as a football player, provides a protective pad which improves the ability of the wearer of the sports pad to hold on to a ball, such as a football. The sports pad includes a tubular member which defines first and second opposed open ends and has a padded section. A high friction surface is provided on the tubular member, which extends from the first open end to the second open end and at least over a non-padded section of the tubular member. Preferably, the high friction surface is formed form a high friction material, such as vinyl material, a PVC material, a rubber material, a neoprene material, or a latex material. The high friction surface may include projections formed from the high friction material.

19 Claims, 6 Drawing Sheets

U.S. PATENT DOCUMENTS

| | | | | |
|---|---|---|---|---|
| 5,146,628 | | 9/1992 | Herrmann et al. . | |
| 5,150,475 | | 9/1992 | Hansen et al. . | |
| 5,298,001 | | 3/1994 | Goodson . | |
| 5,329,638 | | 7/1994 | Hansen et al. . | |
| 5,418,980 | * | 5/1995 | Kelly | 2/170 |
| 5,500,956 | | 3/1996 | Schulkin et al. . | |
| 5,625,900 | | 5/1997 | Hayes . | |
| 5,638,546 | * | 6/1997 | Vita | 2/16 |
| 5,647,062 | | 7/1997 | Nigbur . | |

* cited by examiner

ATHLETIC SPORTS PAD

TECHNICAL FIELD AND BACKGROUND OF THE INVENTION

The present invention relates to a sports pad and, more particularly, to an athletic sports pad which can be worn by football players.

Contact sports, such as football, involve varying degrees of intentional contact between players and, thus, often require protective pads to be positioned and located on various parts of the body to protect the player from such contact. In football, players typically wear shoulder pads, hip pads, and the like, which are positioned under the uniform. More recently, football players wear elbow pads, forearm pads, and even hand pads. However, given the generally inflexible nature of such pads, the pads tend to restrict the ability of players to hold onto the football. This is especially true with forearm and hand pads.

Typical forearm pads are constructed of a tubular member, which is formed from an elastic material, and one or more pads which are either positioned in a sleeve provided in the tubular member or attached to the outer surface of the tubular member. The forearm pad, therefore, includes a padded portion, which is somewhat inflexible due to the pad, and an elastic portion, which stretches to permit the wearer of the pad to put the pad on the arm and to permit the wearer to a limited degree to bend his or her arm. When worn on the player's arm, the padded portion is positioned outwardly with the elastic portion facing inwardly toward the player's body. Thus, when the football player carries a ball, the football player must hold the football with his hand and position the football between the elastic portion of the forearm pad and the player's chest to protect the football from being knocked free from the player's grasp. However, the elastic material of the tubular member tends to reduce the football player's grip on the ball since the material has a low coefficient of friction as compared to the football player's skin. Although these forearm and hand pads are highly desirable to protect the hands and forearms of players, especially younger players, from the blows which are normally associated with such contact sports, players often forego wearing such protective gear to increase the player's ability to carry the ball.

Consequently, there is a need for a protective sports pad which permits the wearer of the sports pad to hold a football securely in the player's arm and still provide the adequate protection of the forearm or wrist of the football player against blows from other players.

SUMMARY OF THE INVENTION

Accordingly, the present invention provides a new and unique sports pad, which is especially suitable for protecting the forearms of football players. The sports pad includes a high friction surface which permits the football player to grip a football while wearing the pad. The high friction surface is preferably provided on at least an un-padded portion of the sports pad and may optionally extend around the full circumference of the sports pad.

According to one aspect of the invention, a sports pad includes a tubular member, which defines first and second opposed open ends. The tubular member includes a padded section for protecting an appendage, such as a forearm, of a wearer, such as a football player. The high friction material is formed on the tubular member, which extends from the first open end to the second open end and over at least a non-padded section of the tubular member.

In one preferred aspect, the tubular member includes a sleeve in which an impact absorbing member is inserted to define the padded section.

Preferably, the high friction surface comprises a pattern which is formed from a neoprene material, a vinyl material, a PVC material, a rubber material, or a latex material. Furthermore, the high friction surface preferably extends between the terminal edges of the padded section to thereby completely cover the un-padded portion of the tubular member.

In other forms, the first open end of the tubular member may include a looped portion, which extend over a thumb of a wearer of the sports pad. Preferably, the looped portion includes an outer surface which includes a high friction surface.

As will be understood, the sports pad of the present invention protects the appendage of the player without hampering the player's ability to hold a ball, such as a football. Preferably, the sports pad comprises a forearm pad however; however, the sports pad may be increased in size to extend the protection to the wrist of the wearer of the sports pad or may be reduced to localize the protection, for example, to the wrist area of the player.

These and other objects, advantages, purposes, and features of the invention become more apparent from a study of the following description taken in conjunction with the drawings.

DESCRIPTION OF THE PREFERRED EMBODIMENTS

Figure 1:
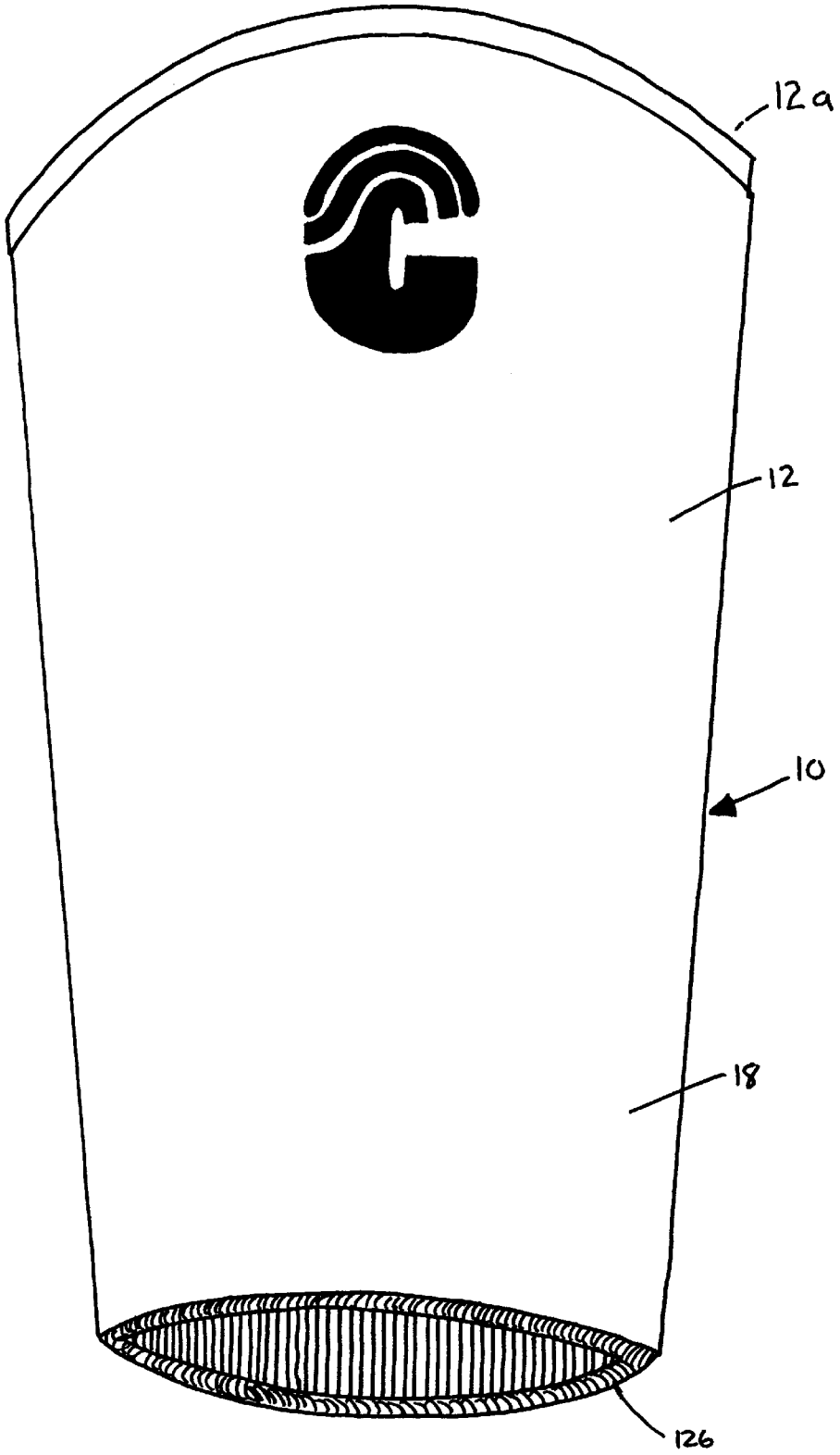
FIG. 1 is a perspective view of an athletic sports pad of the present invention.

Referring to FIG. 1, numeral 10 generally designates a sports pad of the present invention, which is particularly suitable for use by football players who wish to protect an appendage, such as a forearm, and, yet, be able to securely hold a football. Sports pad 10 includes a tubular member or shell 12 which is preferably formed from an elastic material or fabric, including a knitted fabric, for example a polycotton blend, lycra, spandex, polyester, rayon, nylon, neoprene, or the like. Tubular shell 12 includes first and second open ends 12*a* and 12*b* with open end 12*b* being sized to fit around a wrist of the wearer of the sports pad and open end 12*a* being sized to fit around the upper portion of the forearm of the wearer of the sports pad. The thickness of the material forming tubular shell 12 may be varied as would be understood by those skilled in the art, and may include, for example .00 gage material or greater.

Figure 4:
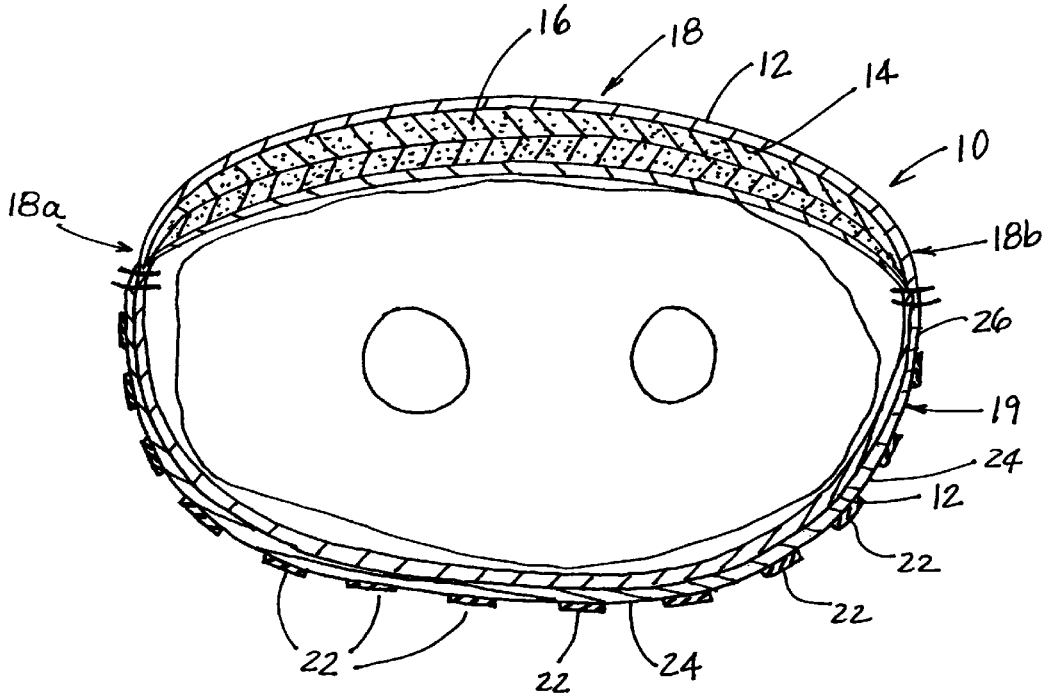
FIG. 4 is a cross-sectional view taken along line IV—IV of FIG. 2.

As best seen in FIG. 4, sewn or formed on tubular shell 12 is a sleeve 14 in which an impact absorbing member or pad 16 is positioned. Pad 16 provides protection to the wearer of sports pad 10 from intentional contact during a contact support such as football. In the illustrated embodiment, pad 16 comprises an elongated, generally rectangular pad which includes terminal edges 18*a* and 18*b* which are circumferentially spaced about tubular member 12. Preferably, pad 16 extends from first open end 12*a* to second open end 12*b* to completely cover the players forearm. Referring again to FIG. 4, pad 16 extends over approximately 180° of tubular member 12. Pad 16 may comprise a unitary pad or may comprise a segmented pad made up from a plurality of pad segments (not shown). Pad 16 may comprise an open cell or closed cell foam, such as BOLLARD™ foam, F-SHELL™ foam, polyolefin foam, gel foam, and the like.

Figure 2:
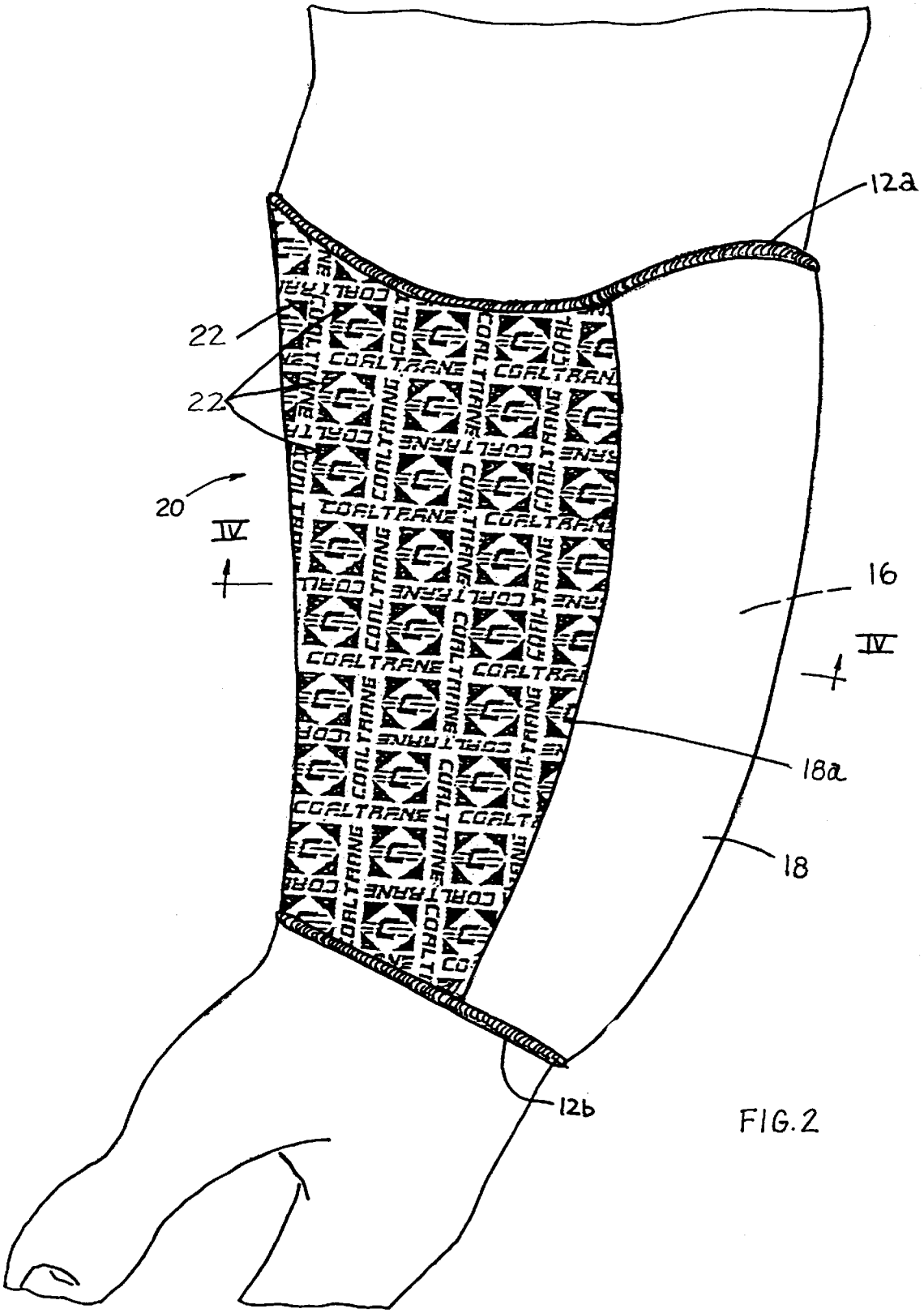
FIG. 2 is a side elevation of the sports pad of FIG. 1 positioned on an arm of a sports player.

As best seen in FIG. 2, when worn on the arm of a player, padded section 18 of sports pad 10 is oriented on the arm to face outwardly from the player. Applied to an inwardly facing portion 19 of tubular shell 12, is a high friction surface 20. Preferably, high friction surface 20 extends between the circumferentially spaced apart terminal edges 18*a* and 18*b* of padded section 18 and between open ends 12*a* and 12*b* of tubular member 12 to thereby completely cover the un-padded portion of tubular shell 12.

Figure 3:
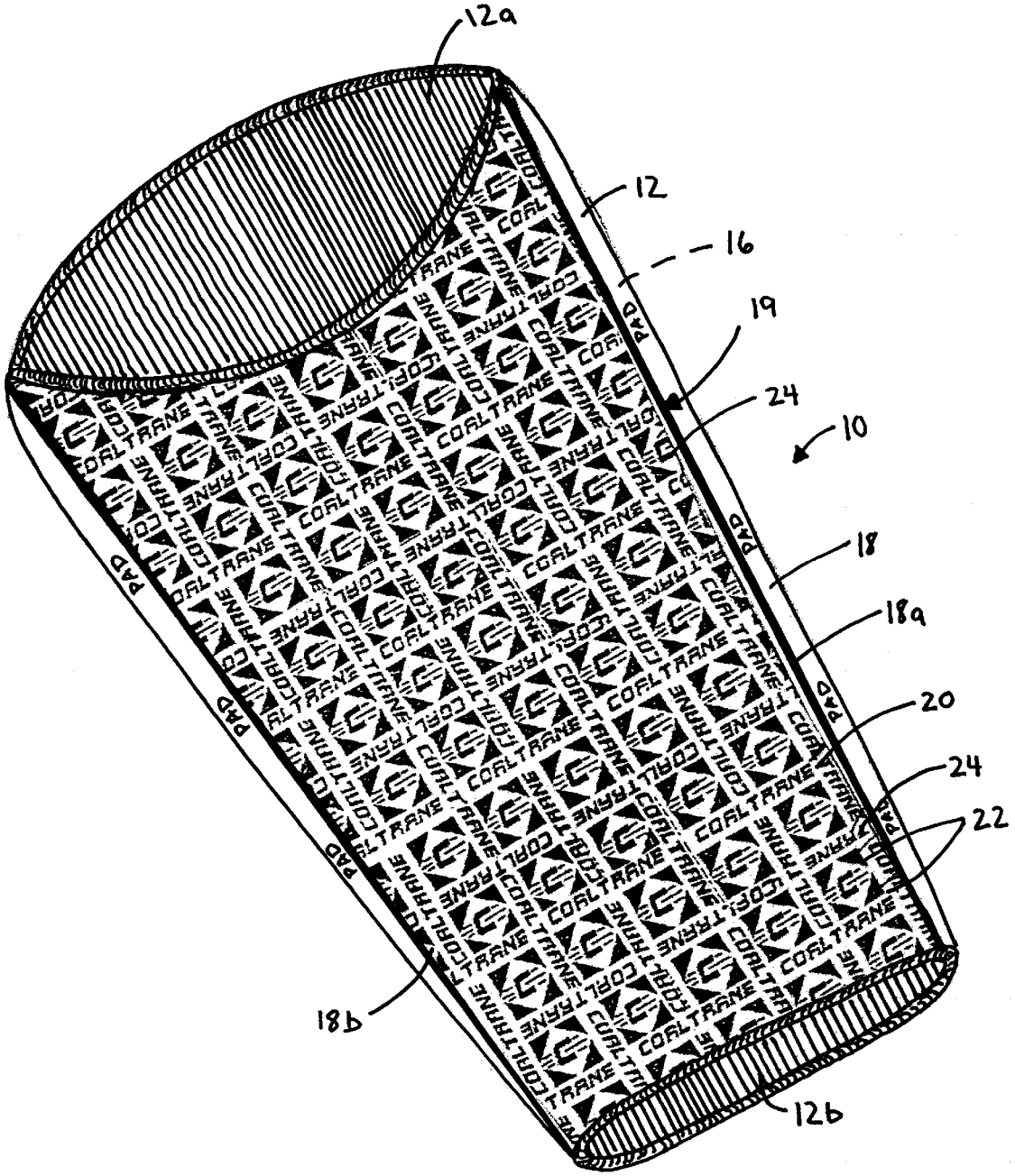
FIG. 3 is a bottom plan view of the sports pad of FIG. 1.

Referring to FIG. 3, high friction surface 20 may comprise a plurality of projections 22 formed from a skid resistant material, such as neoprene, PVC, rubber, vinyl, or latex, or the like, which is applied to the tubular shell substrate. In the illustrated embodiment, projections 22 form a pattern on tubular member 12. Preferably, high friction surface 20 includes interstices or spaces 24 between projections 22 to allow tubular member 12 to stretch or flex as needed when tubular member 12 is put on the player's arm and to allow the player's arm to bend at least to a limited degree. Alternately, high friction surface 20 may be applied to a panel 26 of generally elastic material, such as described in reference to the tubular member's material, which is then applied to the inwardly facing outer surface of sports pad 10 by, for example, stitches, an adhesive, or the like.

Figure 5:
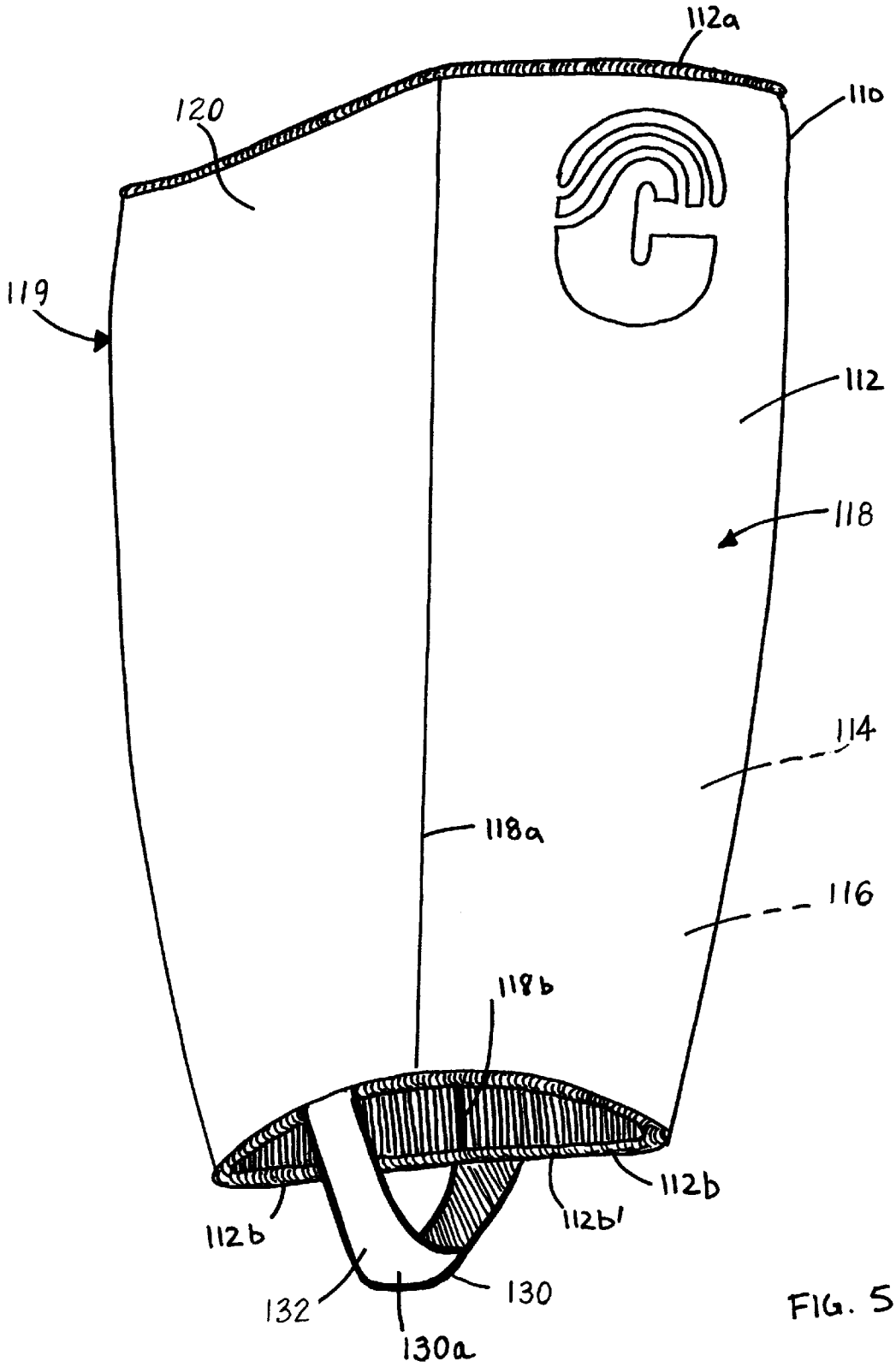
FIG. 5 is a perspective view of second embodiment of the athletic sports pad of the present invention.
Figure 6:
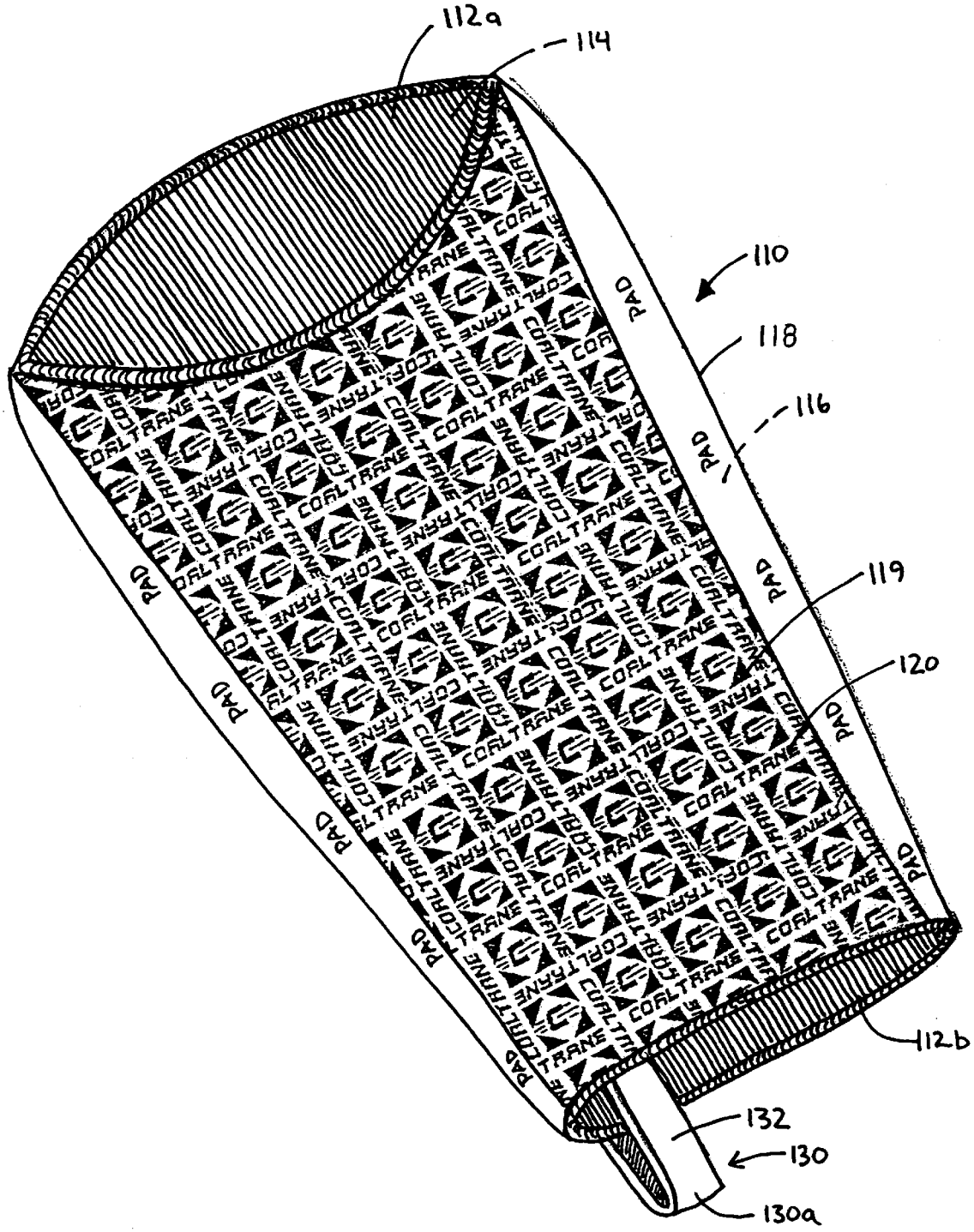
FIG. 6 is a bottom plan view of the athletic sports pad of FIG. 5.

Referring to FIG. 5, a second embodiment 110 of the sports pad of the present invention is illustrated. Sports pad 110 includes a tubular member or shell 112 which is formed from a generally elastic material, similar to that described in reference to the first embodiment. Shell 112 includes a sleeve 114, which extends from a first open end 112*a* of shell 112 to a second open end 112*b* of shell 112. Inserted in sleeve 114 is a pad 116, which preferably extends the full length of sleeve 114. Optionally, pad 116 may comprise a plurality of pad segments in order to provide greater flexibility of sports pad 110 while being worn on the forearm of a football player. Pad 116 is of similar construction to pad 16 and, therefore, reference is made to the first embodiment for preferred forms of pad 116.

When worn by a football player, pad 116 is preferably oriented outwardly in order to define a padded section 118 of sports pad 110, which protects the forearm from impact from another player. Similar to the first embodiment, pad 110 includes a high friction surface on an opposed side or un-padded portion 119 of tubular shell 112. Preferably, high friction surface 120 extends between circumferentially spaced terminal edges 118*a* and 118*b* of padded section 118 and between first and second open ends 112*a* and 112*b*. Reference is made to the first embodiment for further details of high friction surface 120.

Secured to second end 112*b* of tubular shell 112 is a loop or looped portion or extension member 130 which extends between the padded section 112*b*' of opening 112*b* and the high friction surface portion 112*b*" of opening 112*b* in order to extend over the thumb of the wearer of the sports pad 110. Loop 130 preferably also includes a high friction surface 132 which is applied to the outwardly extending surface 130*a* of loop 130. Reference is made to the description of high friction surface 20 of the first embodiment of further details of high friction surface 132. Optionally, open end 112*b* of tubular shell 112 may be sized to extend over the palm of the wearer's hand in order to protect the wrist of the players arm.

In this manner, when sports pad 10 or 110 is worn by a player, such as a football player, sports pad 10 or 110 increases the grip of the football player on the football while reducing the risk of injury to the football player's arm.

Figure 7:
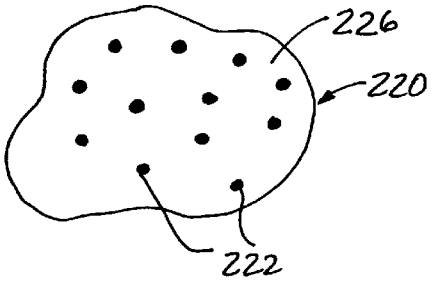
FIG. 7 is a second embodiment of a high friction surface which may be formed on the athletic sports pad of the present invention.

Referring to FIGS. 7–10, alternate embodiments of high friction surface 20 or 120 are shown. Specifically, FIG. 7 illustrates a high friction surface 220 which comprises a plurality of spaced apart round projections 222 which are formed from a high friction material, such as described in reference to the first embodiment. As described in reference to the high friction surface of the first embodiment, the plurality of spaced apart projections 222 may be applied to the surface of the tubular shell substrate or otherwise applied to a panel 226 of generally elastic material which is then applied to the inwardly facing outer surface of the tubular member 12 or 112 by stitches, an adhesive, or the like.

Figure 8:
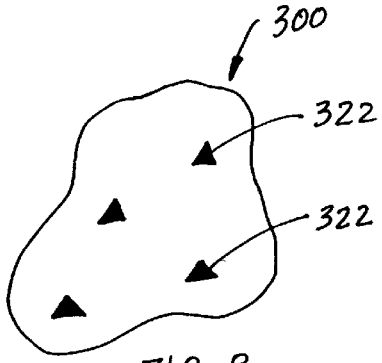
FIG. 8 is a third embodiment of the high friction surface of the athletic sports pad.

As best seen in FIG. 8, a third embodiment 320 of high friction surface is shown which comprises a plurality of triangular shaped projections 322 which are formed from a high friction material, such as described in reference to the first embodiment. Projections 322 may be arranged in a pattern, as shown, or may be scattered in a random fashion. As described in reference to the previous embodiments, projections 322 may be applied directly to the elastic material substrate of the tubular member 12 or 112 or may be applied to a panel 326, which in turn is applied to the tubular member 12 or 112.

Figure 9:
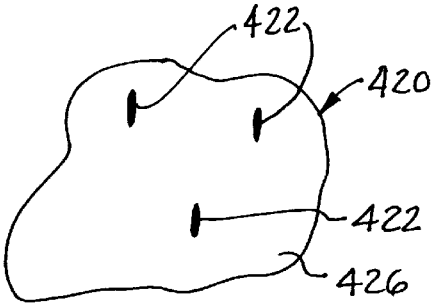
FIG. 9 is a fourth embodiment of the high friction surface of the athletic sports pad.

A fourth embodiment of 420 of high friction surface is shown in FIG. 9. High friction surface 420 comprises a plurality of elongated projections 422 are formed from a high friction material, such as described in reference to the first embodiment. In addition, projections 422 may be arranged in a regular pattern or may have a random pattern. Similar to the previous embodiments, projections 422 may be applied directly to the tubular member substrate or may be applied to a panel 426 of generally elastic material which is then secured by, for example, stitches, an adhesive, or the like, to the tubular shell 12 or 112.

Figure 10:
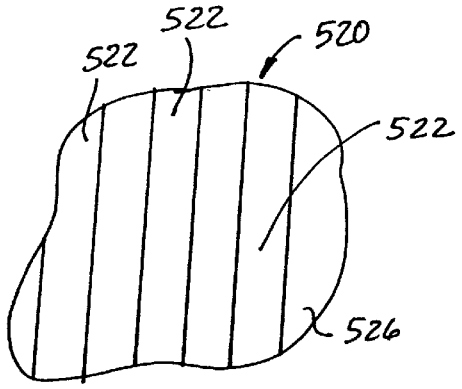
FIG. 10 is a fifth embodiment of a high friction surface for the athletic sports pad.

As best seen in FIG. 10, another embodiment 520 of the high friction surface is shown. High friction surface 520 comprises a plurality of spaced apart stripes or striped projections 522 formed from a high friction material, such as described in reference to the first embodiment. Preferably, stripes 522 comprise raised or projecting stripes and are arranged to extend generally parallel to the longitudinal axis of the tubular member 12 or 112. Stripes 522 may be uniformly spaced or spaced at varying intervals. Similarly, strips 522 may have varying thicknesses. Similar to the previous embodiments, striped projections 522 may be applied directly to the tubular member substrate or may be applied to a panel 526 of generally elastic material which is then secured by, for example, stitches, an adhesive, or the like, to the tubular shell 12 or 112.

In addition, sports pad 10 or 110 preferably includes a tubular member 12 or 112 which is treated by a water repellant, for example SCOTCH GUARD. In this manner, when the user of the sports pad is engaged in outdoor activities when it is raining or snowing, sports pad 12 or 112 will remain relatively dry. Consequently, the player will still have an enhanced grip on the football.

While several forms of the invention have been shown and described, other forms will now become apparent to those skilled in the art. For instance, the length of the sports pad may be increased or decreased to provide a thumb to elbow protector or a thumb to wrist protector. In addition, the loop portion of the second embodiment of the sports pad may be increased or modified to accommodate more than the thumb of the wearer, for example the loop portion may include multiple loop sections which extend between the fingers of the football player's hand. Moreover, the padded section of the sports pad may be extended further around the arm of the player to extend more than 180° around the tubular member in order to provide enhanced protection for the forearm of the player. Likewise, the padded section of the sports pad may be decreased to cover less than 180° of the tubular shell of the sports pad where less protection and greater flexibility is desired. It should also be understood that the high friction surface may be formed from a plurality of different designs, symbols, logos, or shapes formed from the high friction material or may be solid. Additionally, the high friction surface may be increased to cover the full outer surface of the tubular member to insure that should the sports pad be inadvertently rotated about the forearm of the player, the player will still have increased grip on the football.

The embodiments of the invention in which I claim exclusive property or privilege is defined as follows:

1. A sports pad comprising:

a tubular member defining first and second opposed open ends and having a padded section and a non-padded section, said first open end including a looped portion, said looped portion for extending over a thumb of a wearer's hand; and a high friction material formed on said tubular member, said high friction material extending from said first open end to said second open end and at least over said non-padded section of said tubular member, and said looped portion including an outer surface, said outer surface including a high friction surface.

2. A sports pad according to claim 1, wherein said tubular member includes a sleeve, said padded section comprising a pad inserted in said sleeve.

3. A sports pad according to claim 1, wherein said layer includes a plurality of projections formed from one of a vinyl material, a PVC material, a rubber material, a neoprene material, and a latex material.

4. A sports pad according to claim 1, wherein said tubular member includes a longitudinal extent, said first and second opposed open ends being aligned along said longitudinal extent, and said padded section including terminal edges, and said terminal edges being circumferentially spaced around said longitudinal extent of said tubular member.

5. A sports pad according to claim 4, wherein said layer of high friction material extends between said terminal edges of said padded section.

6. A sports pad according to claim 5, wherein said layer of high friction material includes a plurality of projections.

7. A sports pad according to claim 6, wherein said high friction material comprises one of a neoprene material, PVC material, a rubber material, a vinyl material, and a latex material.

8. A sports pad according to claim 1, wherein said tubular member is water repellant.

9. A sports pad according to claim 1, wherein said tubular member is sized to extend over at least a substantial portion of a forearm of a wearer of the sports pad.

10. A forearm pad comprising:

a tubular member defining first and second opposed open ends and having a padded section, said first open end being adapted to extend around a lower portion of a wearer's forearm, and said second end being adapted to extend around an upper portion of a wearer's forearm, said first open end including a looped portion, said looped portion for extending over a thumb of a wearer's hand; and a high friction surface formed on said tubular member and on at least a portion of said loop portion, said high friction surface being formed by high friction material, a portion of said high friction material extending from said first open end to said second open end and at least over a portion of said tubular member.

11. A forearm pad according to claim 10, wherein said padded section includes terminal edges, said tubular member including a longitudinal extent and a circumference, said terminal edges being spaced around said circumference to define a non-padded section, and said high friction material extending between said terminal edges over said non-padded section.

12. A forearm pad according to claim 11, wherein said high friction material comprises one of a vinyl material, a PVC material, neoprene material, a latex material, and a rubber material.

13. A forearm pad according to claim 12, wherein said high friction surface includes a plurality of projections formed from one of a vinyl material, a PVC material, a neoprene material, a latex material, and a rubber material.

14. A forearm pad according to claim 13, wherein said tubular member is water repellant.

15. A football forearm pad comprising:

a tubular member formed from an elastic material defining first and second open ends, said first open end being adapted to extend around a lower portion of a forearm of a football player and including a looped portion extending over a thumb of the football player, and said second end being adapted to extend around an upper portion of the forearm of the football player;

a pad secured to said tubular member, said pad including terminal edges; and a layer of high friction material provided on at least a portion of said tubular member and on at least a portion of said looped portion, said layer extending between said terminal edges of said pad over a non-padded portion of said tubular member.

16. A football forearm pad according to claim 15, wherein said pad extends from said first open end to said second open end.

17. A football forearm pad according to claim 15, wherein said layer extends from said first open end to said second open end.

18. A football forearm pad according to claim 17, wherein said pad includes terminal edges, said layer of high friction material extending between said terminal edges of said tubular member.

19. A football forearm pad according to claim 18, wherein said elastic material is water proof.

* * * * *